US006517007B2

(12) United States Patent
Kong

(10) Patent No.: US 6,517,007 B2
(45) Date of Patent: Feb. 11, 2003

(54) TOY RACING CAR TRACK SECTION

(75) Inventor: Kwok Leung Kong, Kowloon (HK)

(73) Assignee: Artin Industrial Co., Ltd., Kowloon (HK)

( * ) Notice: Subject to any disclaimer, the term of this patent is extended or adjusted under 35 U.S.C. 154(b) by 0 days.

(21) Appl. No.: 09/727,785

(22) Filed: Dec. 4, 2000

(65) Prior Publication Data

US 2002/0066795 A1 Jun. 6, 2002

(51) Int. Cl.[7] ..... E01B 23/00
(52) U.S. Cl. ..... 238/10 F; 104/53
(58) Field of Search ..... 238/10 F, 10 A, 238/10 E; 104/304, 305, 60, 53; 472/91; 446/429, 444, 445; 463/61, 62, 64, 59; 273/86 R, 86 B

(56) References Cited

U.S. PATENT DOCUMENTS 3,359,920 A * 12/1967 Iammatteo ..... 104/160
3,496,674 A * 2/1970 Cooper ..... 116/203
3,589,063 A * 6/1971 Genin ..... 46/216
4,185,409 A * 1/1980 Cheng ..... 46/1 K
4,327,519 A * 5/1982 Cooper et al. ..... 46/262
4,355,807 A * 10/1982 Prehodka ..... 273/86 R
4,382,599 A * 5/1983 Tilbor ..... 273/86 B
4,415,157 A * 11/1983 Lahr ..... 273/86 B
4,513,966 A * 4/1985 Mucaro et al. ..... 273/58 B
5,174,569 A * 12/1992 Ngai ..... 273/86 R
5,254,030 A * 10/1993 Ostendorff et al. ..... 446/430
5,403,004 A 4/1995 Kennedy ..... 273/86 R
5,542,668 A * 8/1996 Casale et al. ..... 463/59
6,173,654 B1 * 1/2001 Ngai ..... 104/295

* cited by examiner

*Primary Examiner*—S. Joseph Morano
*Assistant Examiner*—Frantz F. Jules
(74) *Attorney, Agent, or Firm*—Leydig, Voit & Mayer, Ltd.

(57) ABSTRACT

A track section for a toy racing car track system including a loop of track sections connected end-to-end, the track section including two lanes for respective electric toy cars to race with each other. Each lane includes a groove for guiding movement of a respective toy car having a bottom guide pin received in the groove and a pair of conductive rails on opposite sides of the groove for supplying electrical power to the toy car. The track section includes a body with two lanes, a hindering device or spring-up ramp in each lane, and a trigger mechanism in each lane and including a movable component mechanically associated with the ramp of the opposite lane for movement by the respective toy car to trigger the ramp of the opposite lane for hindering the movement of the toy car traveling in the opposite lane.

7 Claims, 8 Drawing Sheets

TOY RACING CAR TRACK SECTION

The present invention relates to a track section for use in an electric toy racing car track system.

BACKGROUND OF THE INVENTION

In a conventional construction of the type concerned, the electric toy racing car track system includes a loop of track sections which are connected end-to-end together to form a pair of co-extending lanes for respective toy cars to race with each other. Each lane is provided with a central groove for guiding a respective toy car by its bottom guide pin and a pair of conductive rails on opposite sides of the guiding groove for supplying electrical power to the toy car via respective brush contacts on the bottom of the car.

In the majority of cases, each player controls his own car to compete with the car of the rival player in terms of speed. Apart from that, there is not much interaction between the two cars by the players. Some track sections provide a cross junction between the two lanes for swapping the sides on which the cars run, but this arrangement has been known for a long time.

In order to add more fun and variation to the game, the subject invention seeks to provide a track section for a toy racing car track system, which allows one player to change the condition of the lane of the opponent.

SUMMARY OF THE INVENTION

According to the invention, there is provided a track section for use in a toy racing car track system formed by a loop of track sections connected end-to-end together to form at least two lanes for respective electric toy cars to race with each other. Each lane includes a groove for guiding the movement of the respective toy car by a bottom guide pin and a pair of conductive rails on opposite sides of the groove for supplying electrical power to the respective toy car. The track section comprises a body providing said two lanes, a hindering device provided in each lane, and a trigger mechanism provided in each lane and including a movable component mechanically associated with the hindering device of the opposite lane for movement by thee respective toy car to trigger the hindering device of the opposite lane for hindering the movement of the upcoming rival toy car.

Preferably, each trigger mechanism includes a trigger extendable into the guiding groove of the respective lane for movement by the bottom guide pin of the respective toy car and in turn moving the movable component to trigger the hindering device of the opposite lane.

In one aspect of the invention, each hindering device comprises a movable member arranged upon trigger to increase the travelling distance of the upcoming rival toy car.

In a first preferred embodiment, the movable member of each hindering device is arranged upon trigger to divert the upcoming rival toy car to briefly move at an acute angle upwards from the body, thereby increasing its travelling distance.

More preferably, the movable member of each hindering device comprises a pivotable ramp which is resiliently biassed by means of a spring to incline at the acute angle upwards and is normally retained to lie flat relative to the body by the movable component of the trigger mechanism of the opposite lane.

Further more preferably, the movable component of each trigger mechanism is resiliently biassed by means of a spring to retain the ramp of the opposite lane to lie flat relative to the body, such that the ramp can be manually pressed down to and be retained in: the flat position.

It is preferred that each trigger mechanism includes a rotatable spoke-wheel which has a plurality of spokes individually extendable into the guiding groove of the respective lane for movement by the bottom guide pin of the respective toy car whereby the spoke-wheel is turned, said spoke-wheel including at least one cam for upon turning moving the respective movable component to release the ramp of the opposite lane.

More preferably, a spoke of each spoke-wheel is accessible on the outside of the body to enable manual adjustment of the angular position of the spoke-wheel.

More preferably, the number of cam(s) is smaller than the number of spokes of the same spoke-wheel, such that the spoke-wheel does not always move the respective movable component to release the ramp of the opposite lane every time the respective toy car passes by.

More preferably, each spoke-wheel includes a ratchet-wheel which is engageable with a spring-loaded member to restrict the spoke-wheel to turn-only in one direction and in a stepwise manner.

It is preferred that the movable component of each trigger mechanism comprises a pivotable lever.

In a second preferred embodiment, the movable member of each hindering device is arranged upon trigger to divert the upcoming rival toy car into a side lane, thereby increasing its travelling distance, said side lane branching off from the main lane at a junction on the body.

More preferably, the movable member of each hindering device is provided at the junction and is movable between a first position to allow the rival toy car to travel past the junction along the main lane and a second position to divert the rival toy car into the side lane.

Further more preferably, the movable member of each hindering device comprises a wedge supported for lateral sliding movement between the first and the second positions.

Further more preferably, each trigger mechanism comprises a linkage which is formed by a first link acting as the respective movable component and having a part extendable into the guiding groove of the respective lane for movement by the bottom guide pin of the respective toy car, and by a second link connected with the movable member of the hindering device of the opposite lane.

It is further preferred that the second link has a part extendable into the guiding groove of the side lane branching off from the opposite lane simultaneously when the hindering device of said opposite lane is triggered, for subsequent movement by the bottom guide pin of the rival toy car diverted into said side lane from said opposite lane to reset said hindering device.

It is further preferred that each of the first and second links is hinged at an intermediate position to the body.

It is further preferred that the linkage includes a third link interconnecting the first and second links.

More preferably, the linkage includes a fourth link connected to the third link, said fourth link having a part which is accessible on the outside of the body to. enable manual adjustment of the condition of the linkage and in turn the position of the movable member of the hindering device of the opposite lane.

In another aspect of the invention, each hindering device comprises a movable member arranged upon trigger to stop the movement of the upcoming rival toy car.

Preferably, the movable member of each hindering device is extendable into the guiding groove of the respective lane for blocking the respective toy car.

Preferably, the movable members of the two hindering devices are supported for simultaneous movement in the same direction, and the hindering devices are provided downstream of the trigger mechanisms.

More preferably, the movable member of each hindering device is resettable by the trigger mechanism of the same lane along which a trailing toy car runs, subsequent to trigger by the trigger mechanism of the opposite lane along which a leading toy car runs, such that the movable member will not stop the movement of the trailing car if the trailing car is running less than one lap behind the leading car.

Preferably, each trigger mechanism includes a rotatable spoke-wheel which has a plurality of spokes individually extendable into the guiding groove of the respective lane for movement by the bottom guide pin of the respective toy car whereby the spoke-wheel is turned, the spoke-wheel including a co-axial gearwheel in mesh with and for, upon turning, moving the respective movable component to trigger the hindering device of the opposite lane.

More preferably, the movable components of the two trigger mechanisms are supported for simultaneous movement in the same direction.

Preferably, each hindering device comprises a part which is connected with the respective movable member and is accessible on the outside of the body to enable manual adjustment of the position of the movable member.

The invention also provides a toy car racing track system including the aforesaid track section.

BRIEF DESCRIPTION OF DRAWINGS

The invention will now be more particularly described, by way of example only, with reference to the accompanying drawings, in which.

DETAILED DESCRIPTION OF PREFERRED EMBODIMENTS

Figure 4:
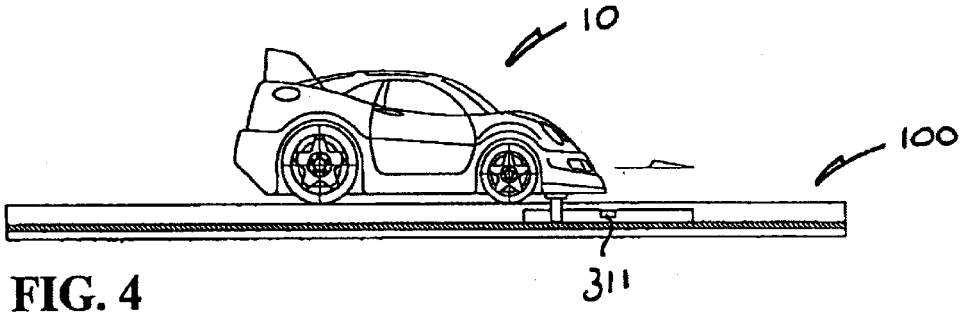
FIG. 4 is a cross-sectional side view of the track section of FIG. 1, taken along one of the lanes and showing a toy car running in this lane to operate the associated trigger mechanism for releasing the ramp of the other lane.

Referring initially to FIGS. 1 to 5B of the drawings, there is shown a first track section 100 embodying the invention for use in a conventional electric toy car racing track system. The track system is typically built by a loop of track sections connected end-to-end together to form a pair of co-extending lanes for respective toy cars to race with each other. Extending along each lane, the track sections include a central groove for guiding a toy car by a bottom guide pin and a pair of conductive rails on opposite sides of the guiding groove for supplying electrical power to the toy- car via respective bottom contact brushes of the car. Most of the track sections are constructed and interconnected in the conventional manner as generally known in the art, except the subject track section 100 which is intended for optional use to enhance the fun and variation of the racing game.

Apart from the usual guiding groove 102 and power-supply rails 103 as mentioned above, each lane 101 of the track section 100 incorporates a spring-up ramp 200 and a trigger mechanism 300 for releasing the ramp 200 of the opposite lane 101. The trigger mechanisms 300 are provided preferably downstream of the ramps 200.

Each ramp 200 has a rectangular flat body 210 including on its upper surface a central guiding groove 212 but no power-supply rails. The ramp body 210 normally lies flat within a matching recess 104 in the upper surface of the track section 100, at a central position with respect to the associated lane 101 such that its groove 212 is aligned with the track section grooves 102 at opposite ends to enable a toy car 10 to run past the ramp 200.

The ramp body 210 has an upstream end 214 which is connected to the same end of the recess 104 by a pair of horizontal hinge pins 215 and a downstream end 216 provided with a forward protruding hook 217. An elbow spring 211 is provided at one of the hinge pins 215 for resiliently biassing the ramp body 210 to pivot upwards out of the recess 104 into a spring-up position. In this position, the ramp body 210 is inclined at an angle of about 10° to the track section 100 and is retained in position by a pair of hinged struts 213 provided underneath its opposite sides.

In use, the ramp 200 diverts an approaching toy car 10 to briefly move at an acute angle upwards from the ramp body 210, thereby hindering the movement of the car 10 by increasing its travelling distance. Moreover, in the absence of any power-supply rails on the ramp body 210, the toy car 10 is required to gather sufficient speed or momentum in order to overcome the ramp 200 and fall back onto the trailing part of the track section 100. Afterwards, the ramp body 210 may be manually pressed back down into the recess 104, whereupon its hook 217 will be caught automatically through a snap action by an adjacent catch 301 of the trigger mechanism 300 on the same lane 101 ahead such that the ramp body 210 will be retained in the previous normal position lying flat within the recess 104.

Each trigger mechanism 300 includes a spoke-wheel 310 having eight equiangular outer spokes 311, a positioning lever 320 and a trigger lever 330, all being provided on the underside of the track section 100. The spoke-wheel 310 includes, as integral parts on its underside, a concentric ratchet-wheel 312 having eight equiangular teeth 313 and a co-axial ring 314 including two outer cams 315 and extending around the ratchet-wheel 312. The teeth 313 and the cams 315 are asymmetrical in the same angular direction and arranged for co-operation with the positioning lever 320 and the trigger lever 330, respectively.

The positioning lever 320 has a far end 322 which is fixed by a central screw 326 to the track section 100, and includes a near end 324 which is relatively thinner and pointed and slightly deflectable about a weakened portion 328. The pointed end 324 extends from one side to in releasable clicking engagement with the teeth 313, thereby defining altogether eight equiangular stable positions for the spoke-wheel 310. The teeth 313 are asymmetrical such that the spoke-wheel 310 is restricted to turn only in one direction X.

The guiding groove 102 of each lane 101 is open on the outer side adjacent the associated spoke-wheel 310 such that the spokes 311 can sweep successively past the interior of the groove 102 and each one of them can extend internally across the groove 102 in the corresponding stable position of the spoke-wheel 310. When the toy car 10 passes by, its bottom guide pin will hit the spoke (trigger) 311 extending across the groove 102, thereby turning the spoke-wheel 310 to the next stable position in a stepwise manner.

Insofar as both positioning levers 320 are concerned, one of each of the trigger mechanisms 300, have their far ends 322 integrally joined together and fixed by the same screw 326. A pair of U-shaped springs 329 extend integrally from the joined ends 322 on the side of the screw 326 opposite to the positioning levers 320 generally and act upon the trigger levers 330, respectively.

Each trigger lever 330 has a first end 332 acting upon the outer side of the ring 314 of the respective spoke-wheel 310 and a second end 334 extending to reach the ramp 200 of the opposite lane 101 and providing the catch 301 for engagement with the hook 217 of that ramp 200. The trigger lever 330 is supported at about mid-length for limited pivotal movement about a hinge 336 provided underneath the track section 100 such that, under the action of the associated spring 329, the trigger lever 330 is resiliently biassed to have its first end 332 urging continually against the outer side of the ring 314.

While the first lever end 332 is urged against the body (excluding the cams 315) of the ring 314, the second lever end 334 is positioned such that the catch 301 is engaged with the hook 217 of the opposite ramp 200. Upon turning of the spoke-wheel 310, and hence the ring 214, from one to the next stable position during which one of the cams 315 comes momentarily in between, the cam 315 momentarily pivots the trigger lever 330 against the action of the spring 329 such that the catch 301 is momentarily withdrawn to disengage from the hook 217, thereby releasing the opposite ramp 200.

Each spoke-wheel 310 has eight spokes 311 but only two cams 315, and the two cams 315 are not positioned symmetrically with respect to the centre of rotation. This design ensures that the spoke-wheel 310 does not always, and in a seemingly unpredictable manner, triggers the catch 301 to release the ramp 200 of the opposite lane every time the toy car 10 passes by.

Figure 1:
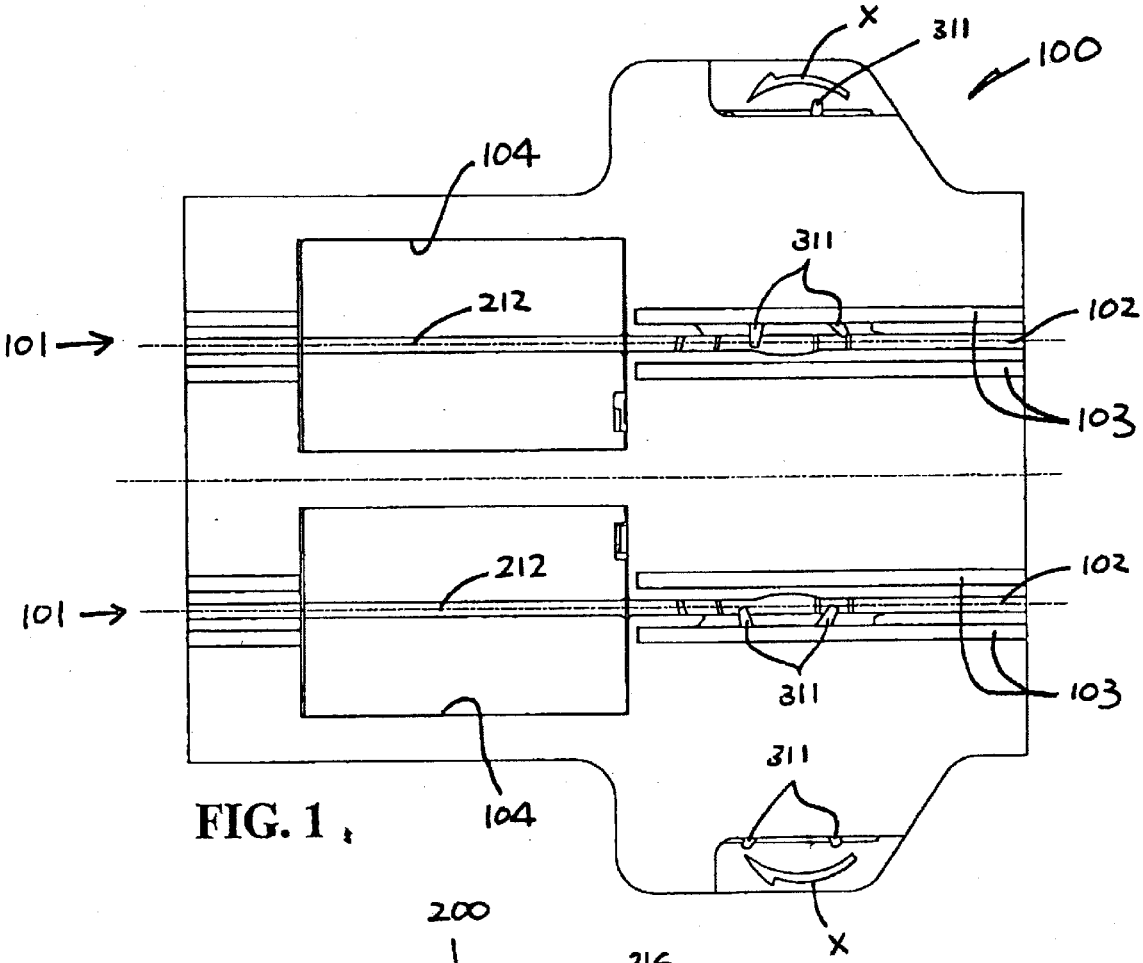
FIG. 1 is a top view of a first embodiment of a toy racing car track section in accordance with the invention, the track section providing two lanes, each of which incorporates a spring-up ramp and a trigger mechanism for releasing the ramp of the other lane.
Figure 5A:
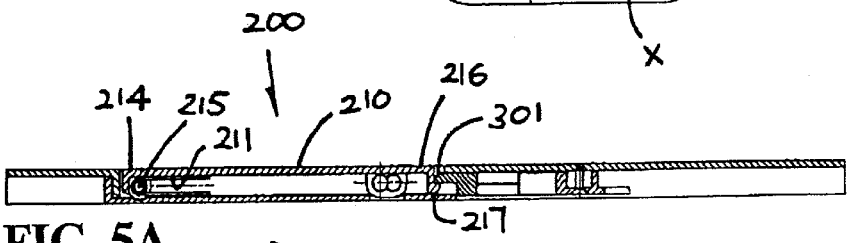
FIGS. 5A and 5B are cross-sectional side views of the track section of FIG. 1, taken along the other lane and showing the associated ramp lying flat within the track section in a normal position and subsequently released into a spring-up position.
Figure 5B:
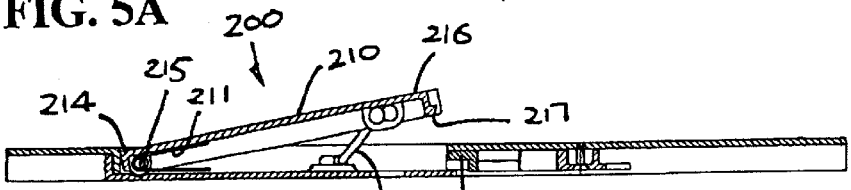
Figure 2:
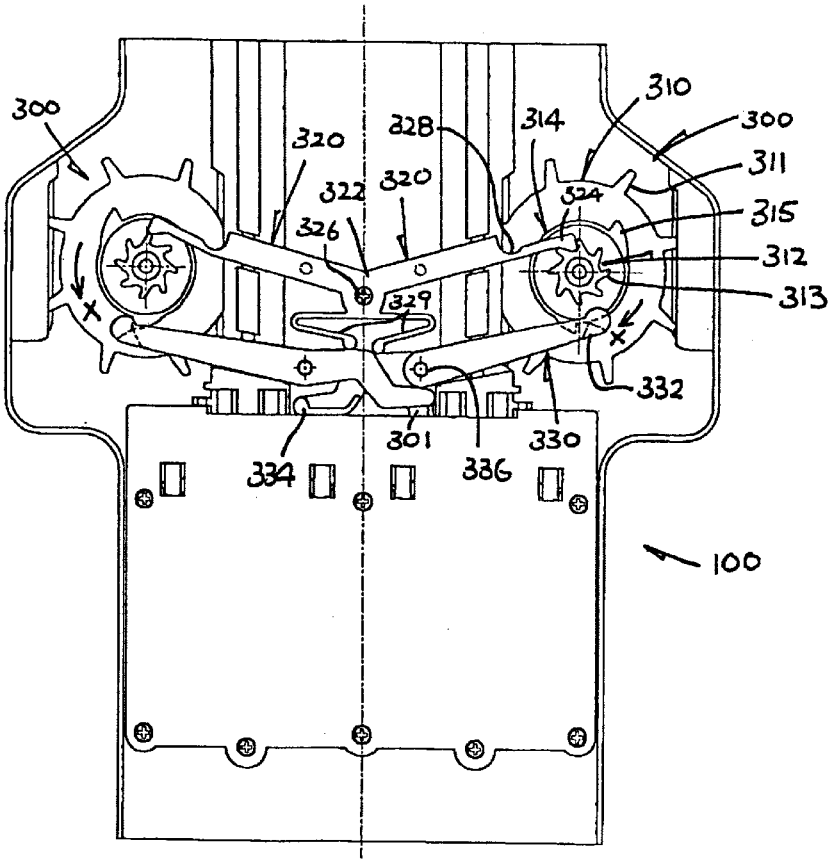
FIG. 2 is a bottom view of the track section of FIG. 1.
Figure 3:
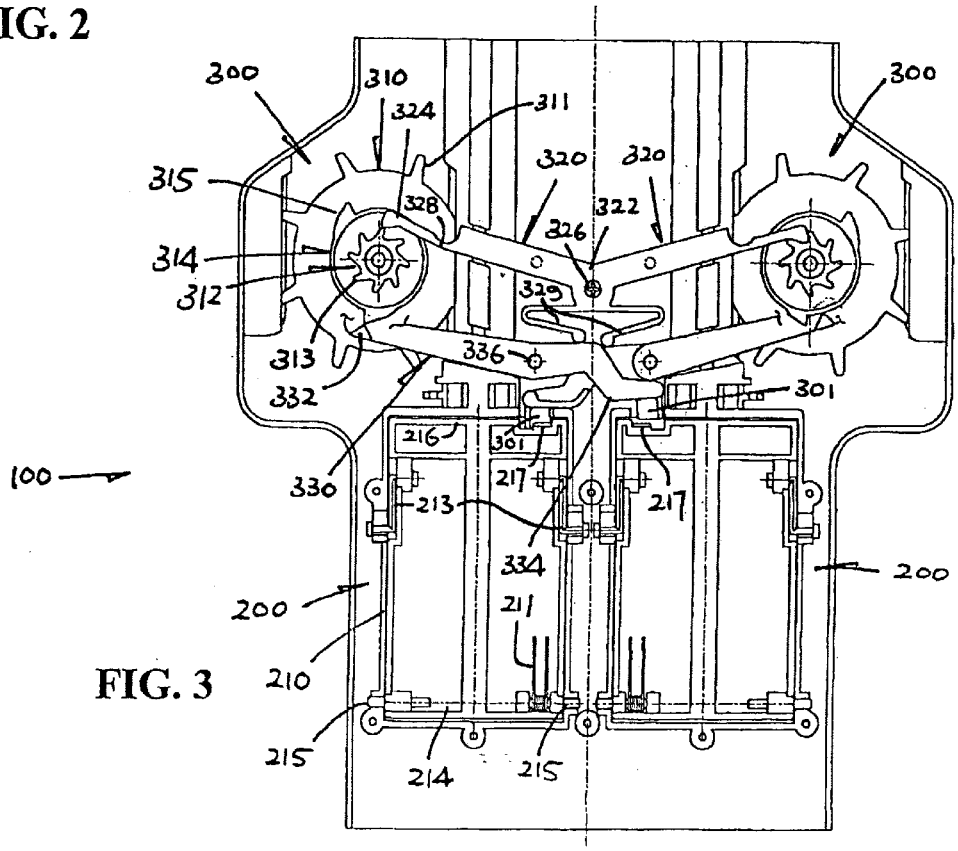
FIG. 3 is a bottom view corresponding to FIG. 2, showing the ramps in greater detail.
Figure 6:
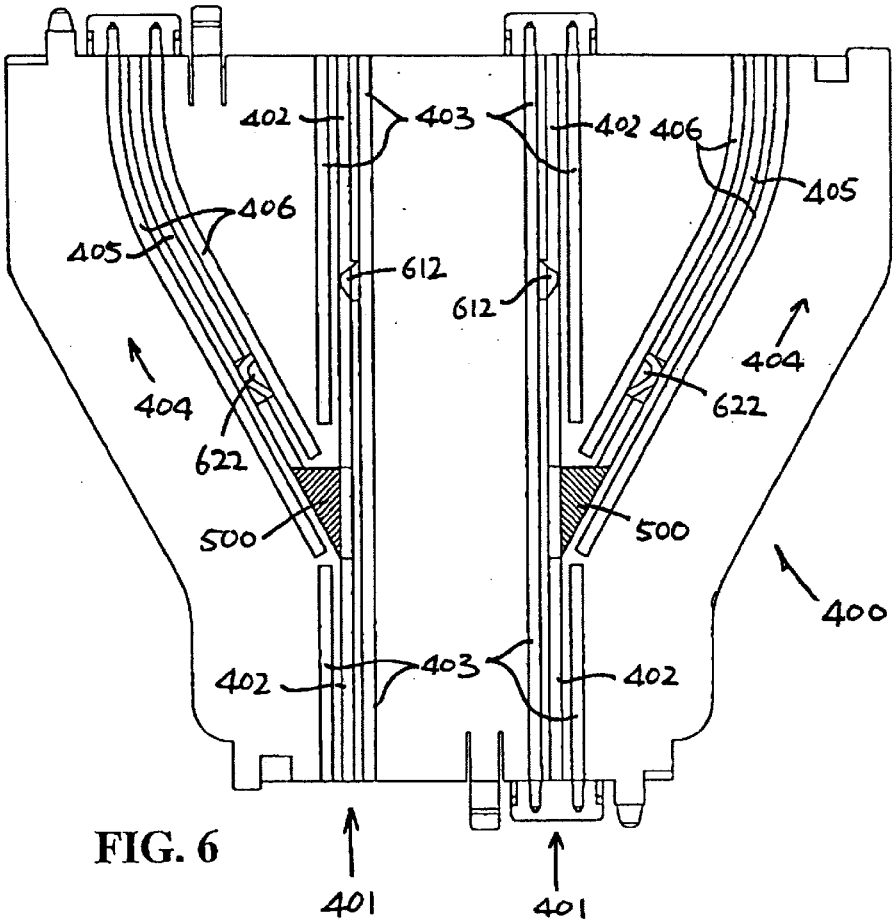
FIG. 6 is a top view of a second embodiment of a toy racing car track section in accordance with the invention, the track section, providing two main lanes and respective side lanes branching off at junctions provided with respective diverters.
Figure 7:
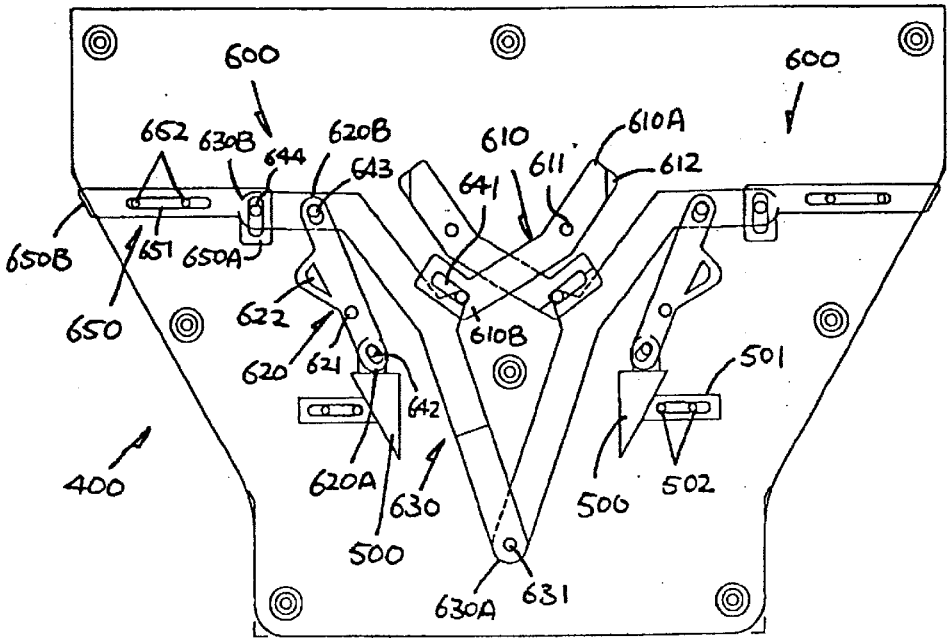
FIG. 7 is a bottom view of the track section of FIG. 6, showing a pair of linkages for operating the corresponding diverters.
Figure 8:
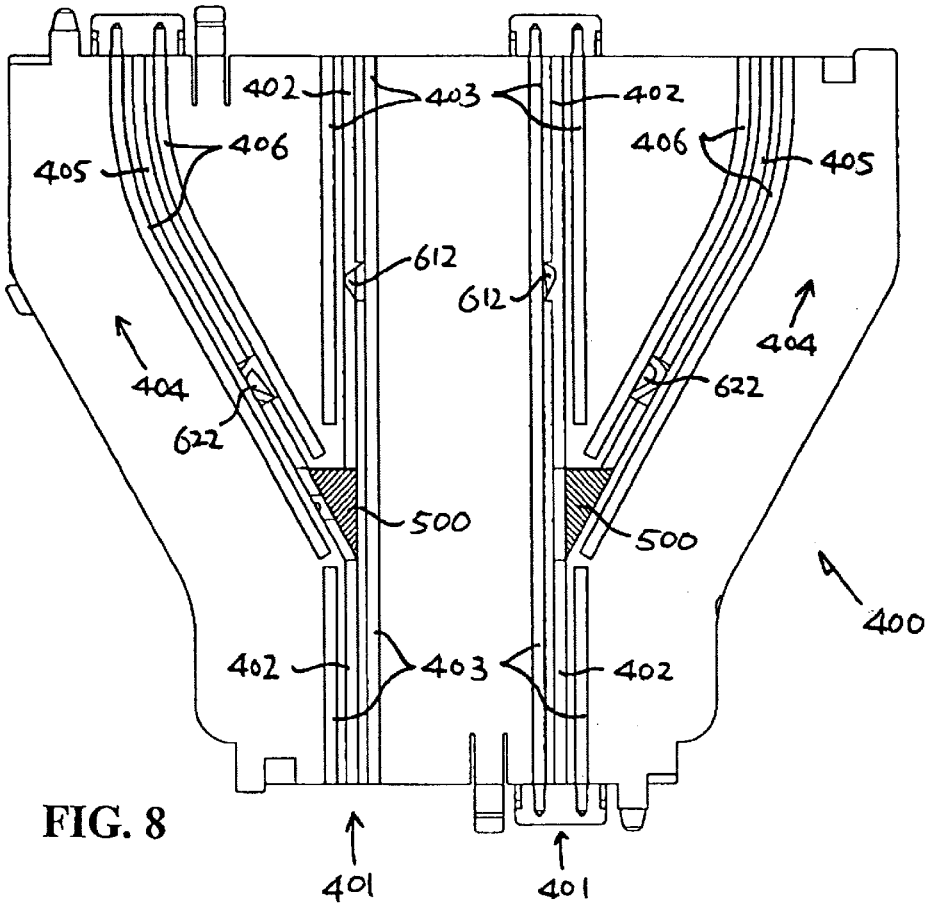
FIG. 8 is a top view corresponding to FIG. 6, showing the left diverter having been operated.

As shown in FIG. 1, two spokes 311 of each spoke-wheel 310 are exposed on opposite outer sides of the track section 100 for access by a player to manually adjust the angular position of the spoke-wheel 310, for example before the start of a new game.

Reference is then made to FIGS. 6 to 9 of the drawings, where is shown a second track section 400 embodying the invention for use in the same type of electric toy car racing track system as described above. The track section 400 includes a pair of co-extending main lanes 401 for respective toy cars to race with each other. Extending along each lane 401, the track section 400 includes a central groove 402 for guiding a toy car by its bottom guide pin and a pair of conductive rails 403 on opposite sides of the guiding groove 402 for supplying electrical power to the toy car via respective bottom contact brushes of the car. The track section 400 additionally includes a respective pit-stop lane 404 on the outer side of each main lane 401, which branches off from the main lane 401 and subsequently (on the following track sections not shown) returns to the main lane 401. The side lane 404 is provided with an equivalent guiding groove 405 and conductive rails 406, and acts as a hindrance to extend or increase the length of the path along which the toy car is diverted to travel or move.

The upstream junction between each main lane 401 and side lane 404 is provided with a respective triangular wedge 500, which is movable between a normal position (FIG. 6) allowing the toy car to travel past the junction along the main lane 401 and a side position (left hand side of FIG. 8) to block the main lane 401 by its guiding groove 402 at the junction for diverting the car into the side lane 404. The wedge 500 is supported for lateral sliding movement by a slotted side bracket 501 in sliding engagement around two pins 502 provided on the underside of the track section 400.

The track section 400 includes a pair of linkages 600 for operating the corresponding wedges 5001 each of which includes a first link 610 associated with a respective own player's main lane 401, a second link 620 associated with the opponent's side lane 404, and a third link 630 coupling the first and second links 610 and 620 together. Each of the first/second links 610/620 is hinged at an intermediate position 611/621 to the track section 400 for limited pivotal movement, whereas the third link 630 is hinged at a position 631 at one end 630A.

One end 610A of the first link 610 has an upstanding knob 612 that is extendable from one side into the guiding groove 402 of the own player's main lane 401 at a position downstream of the junction, and the opposite end 610B of which is connected to the third link 630 by a sliding joint 641. The second link 620 has opposite ends 620A and 620B which are connected by separate sliding joints 642 and 643 to the wedge 500 and the third link 630, respectively. Each of the joints 641 to 643 is implemented by a peg in one connected part in sliding engagement within a slot in the other connected part. At an intermediate position and on one side, the second link 620 includes an upstanding knob 622 that is extendable from one side into the guiding groove 405 of the opponent's side lane 404.

Figure 9:
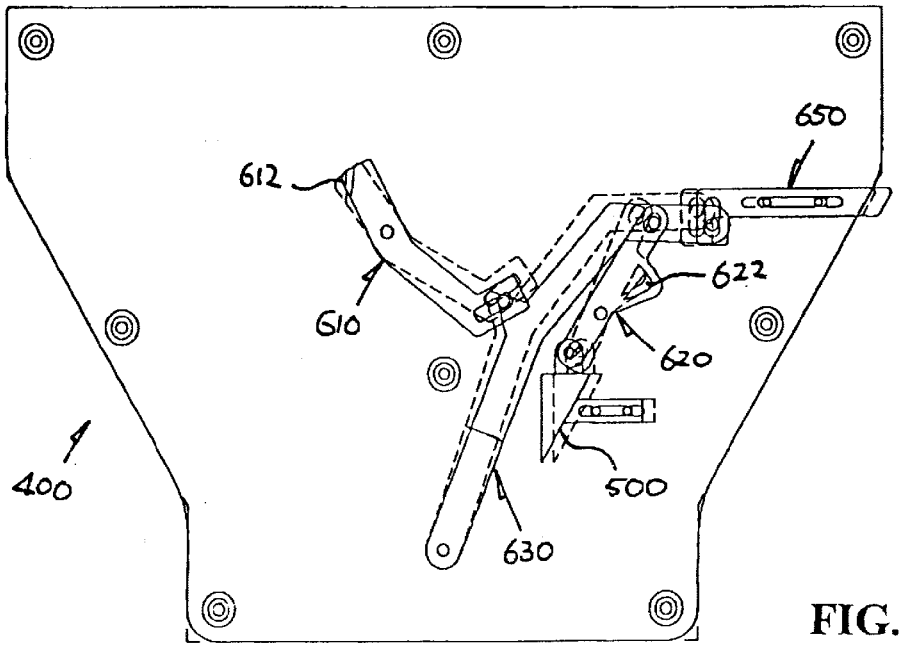
FIG. 9 is a bottom view corresponding to FIG. 7, showing the left linkage in-operation.

Each of the two linkages 600, which are mirror-images of each other, is arranged such that the first and second knobs 612 and 622 are always in opposite conditions, i.e. the first knob 612 extending internally across the groove 402 of one player's main lane 401 and the second knob 622 being withdrawn from the groove 405 of the opponent's side lane 404 (see dashed lines of FIG. 9), or vice versa (see solid lines of FIG. 9). It should be noted that the condition as set out in full puts the opponent's wedge 500 in the aforesaid normal position and that the vice versa condition puts the opponent's wedge 500 in the side position. The car racing game is intended to start with both linkages 600 preset in the condition as set out in full.

During the game, the leading car that passes the junction on its lane first will press, with its bottom guide pin, the corresponding first knob 612 inwards, thereby operating its own linkage 600, which results in two simultaneous consequences. The first consequence is that the opponent's wedge 500 is moved to the side position, whereby the trailing car will be diverted into its side lane 404. The second consequence is that the second knob 622 is extended into and across the groove 405 of the opponent's side lane 404 for subsequent pressing by the bottom guide pin of the trailing car, whereby the opponent's wedge 500 is moved back to the normal position and the triggered linkage 600 is reset.

Each linkage 600 preferably includes a slider 650 connected to the remaining end 630B of the third link 630, which facilitates manual reset of the linkage 600 into the preferred starting condition. The slider 650 is supported for left-and-right movement by a co-extending slot 651 in sliding engagement around two pins 652 provided on the underside of the track section 400. One end 650A of the slider 650 is connected to the end 630B of the third link 630 by a sliding joint 644, and the opposite end 650B of which is arranged to extend out from an adjacent side of the track section 400 when the linkage 600 has been triggered, for depression to reset the linkage 600.

Reference is finally made to FIGS. 10 to 13 of the drawings, where a third track section 700 embodying the invention is shown. Apart from the usual guiding groove 702 and power-supply rails as mentioned above, both lanes 701 of the track section 700 incorporate a common road block mechanism 800 and respective trigger mechanisms 900 for operating the road block mechanism 800 to primarily block the opposite lane 701. The road block mechanism 800 and the trigger mechanisms 900 are provided on the underside of the track section 700, with the former being provided preferably downstream of the latter.

The road block mechanism 800 includes a elongate slider 810 that extends transversely across the underside the track section 700. The slider 810 has opposite ends 820 extendable in opposite directions beyond the corresponding sides of the track section 700 and is preferably as long as the width of the track section 700 such that it can easily be manually slid to a normal central position relative thereto by pushing in the protruding end 820.

Figure 11:
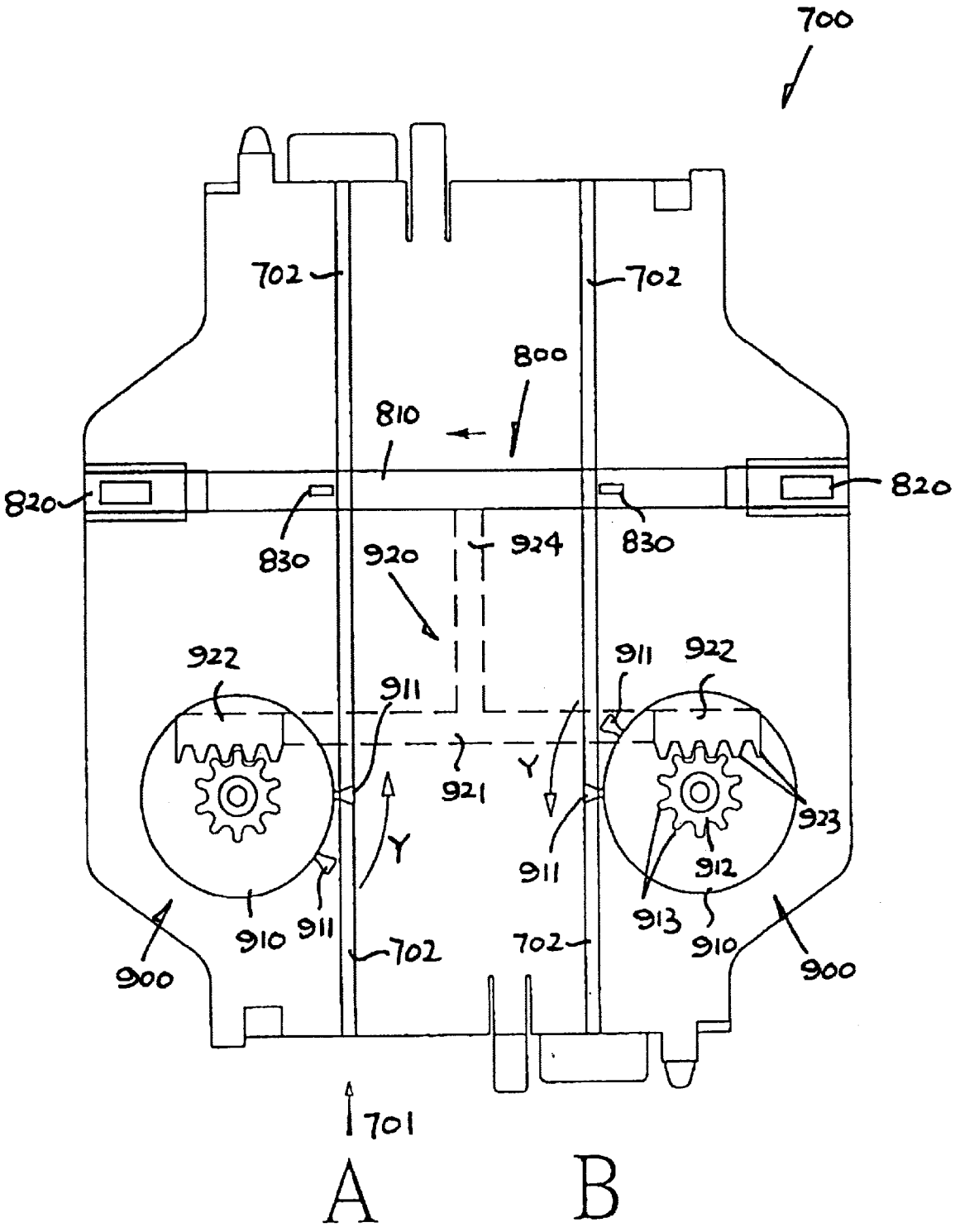
FIG. 11 is a top view corresponding to FIG. 10, showing a subsequent operating condition of the road block and trigger mechanisms.

The slider 810 includes a pair of raised stops 830 which are extendable in either direction internally across the guiding grooves 702 respectively for blocking the same. While the slider 810 is in the normal central position, the stops 830 are located just off the corresponding grooves 702 on their outer sides (FIG. 11).

Each trigger mechanism 900 comprises a spoke-wheel 910 which has ten equiangular outer spokes 911 and includes, integrally on its underside, a concentric gearwheel 912 having ten equiangular teeth 913. The trigger mechanism 900 includes a T-shaped link 920 including a transversely extending first bar 921 which has opposite ends 922 and a central second bar 924 which tees perpendicularly from the first bar 921 to connect with the slider 810. Each end 922 of the first bar 921 includes a series of five teeth 923 meshing with the teeth 913 of the gearwheel 912 on the corresponding side of the track section 700. By reason of the coupling by the first bar 921, both gearwheels 912 and hence spoke-wheels 910 will turn simultaneously in the same direction.

The arrangement is such that rotation of either spoke-wheel 910 and hence the respective gearwheel 912 will cause sliding movement of the T-shaped link 920 and, in turn, the slider 810. Although not shown in the drawings, a spring-loaded lever is provided for each gearwheel 912, which has a free end in releasable clicking engagement with the teeth 913 to define altogether ten equiangular stable positions for the spoke-wheel 910.

The guiding groove 702 of each lane 701 is open on the outer side adjacent the associated spoke-wheel 910 such that the spokes 911 can sweep successively past the interior of the groove 702 and each one of them can extend internally across the groove 702 in the corresponding stable position of the spoke-wheel 910. When a toy car 10 passes by, its bottom guide pin will hit the spoke 911 extending across the groove 702, thereby turning the spoke-wheel 910 to the next stable position.

The position of the slider 810 is determined through turning of either spoke-wheel 910 in opposite directions through some of its stable positions. More specifically, the slider 810 is intended to have only five stable positions, which are the normal central position and two positions in each left/right direction from the central position.

Figure 10:
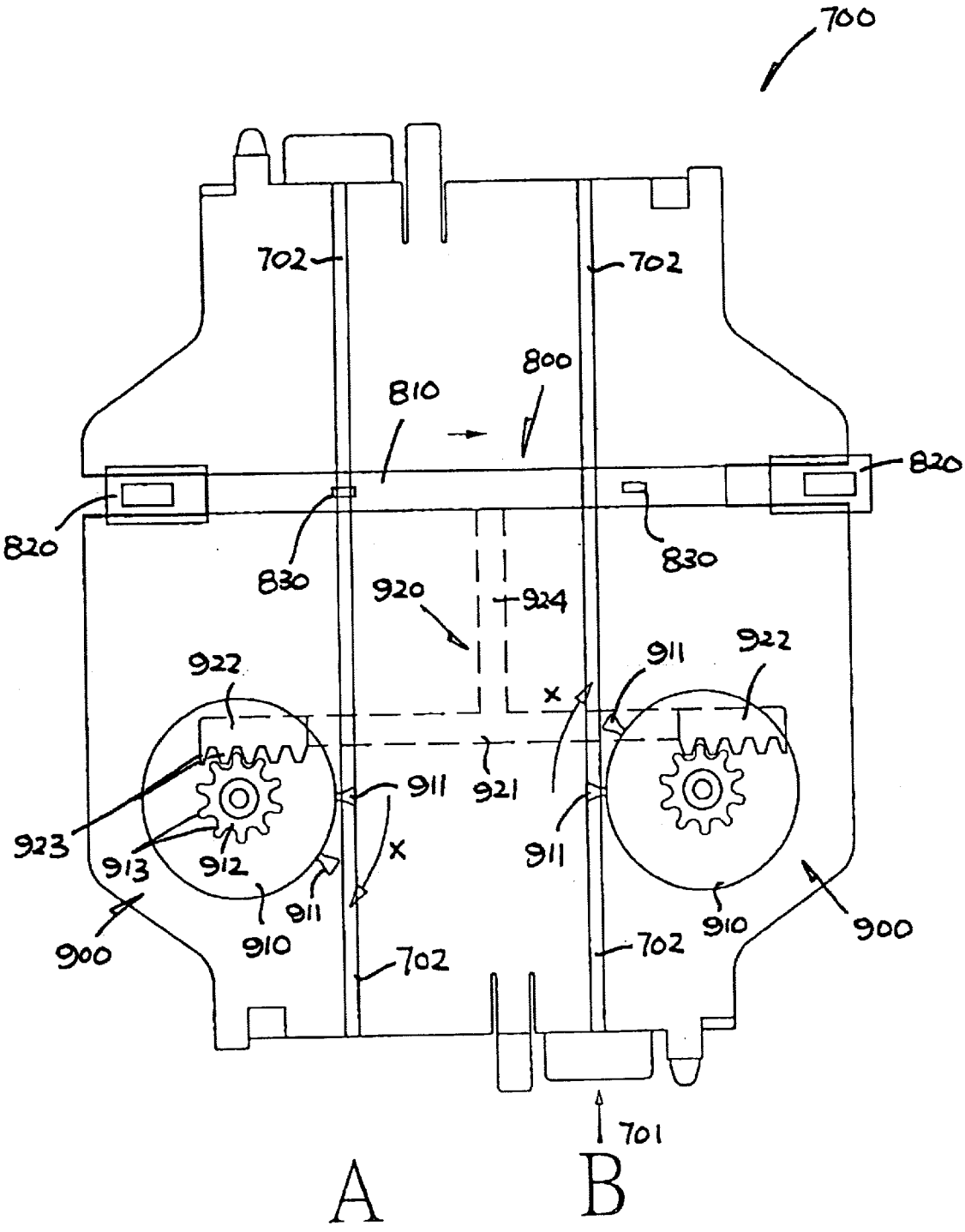
FIG. 10 is a top view of a third embodiment of a toy racing car track section in accordance with the invention, the track section providing two lanes incorporating a common road block mechanism and respective trigger mechanisms for operating the road block mechanism.

The car racing game is intended to start with the slider 810 in the central position, in which the stops 830 are located just off the corresponding grooves 702 on their outer sides (FIG. 11). Upon the leading car on the right lane 701 running past its trigger mechanism 900, the slider 810 is slid to the first next position to the right side of the central position, in which the right stop 830 is moved further away from the right groove 702 and the left stop 830 is moved to extend across the left groove 702, whereby the left lane 701 is blocked (FIG. 10). However, if the trailing car on the left lane 701 is running less than one lap behind the leading car, the slider 810 will quickly be returned or reset to the central position when the trailing car runs past its trigger mechanism 900 (FIG. 11), whereby the trailing car can run through without being blocked.

Figure 12:
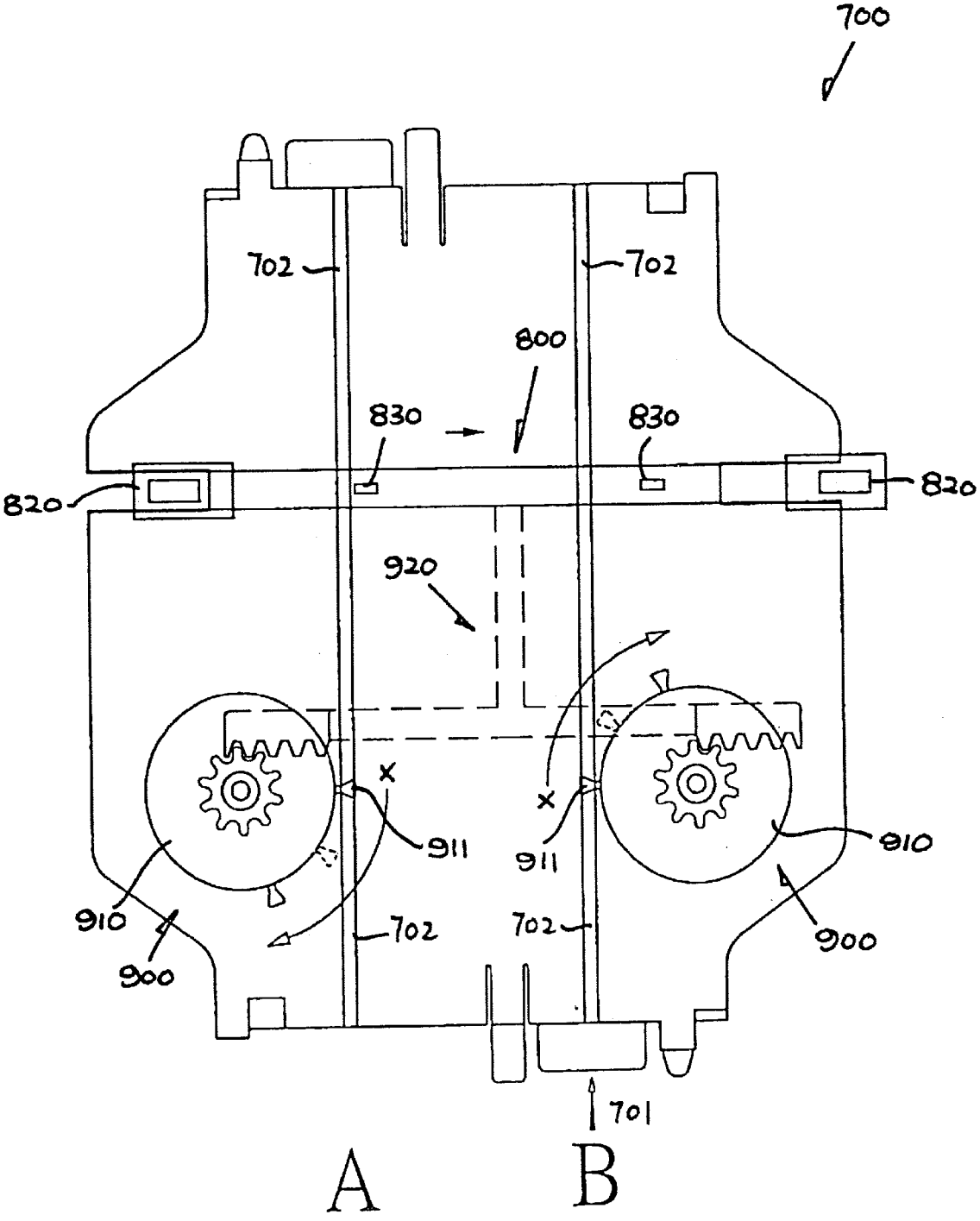
FIG. 12 is a top view corresponding to FIG. 10, showing an alternative subsequent operating condition of the road block and trigger mechanisms.
Figure 13:
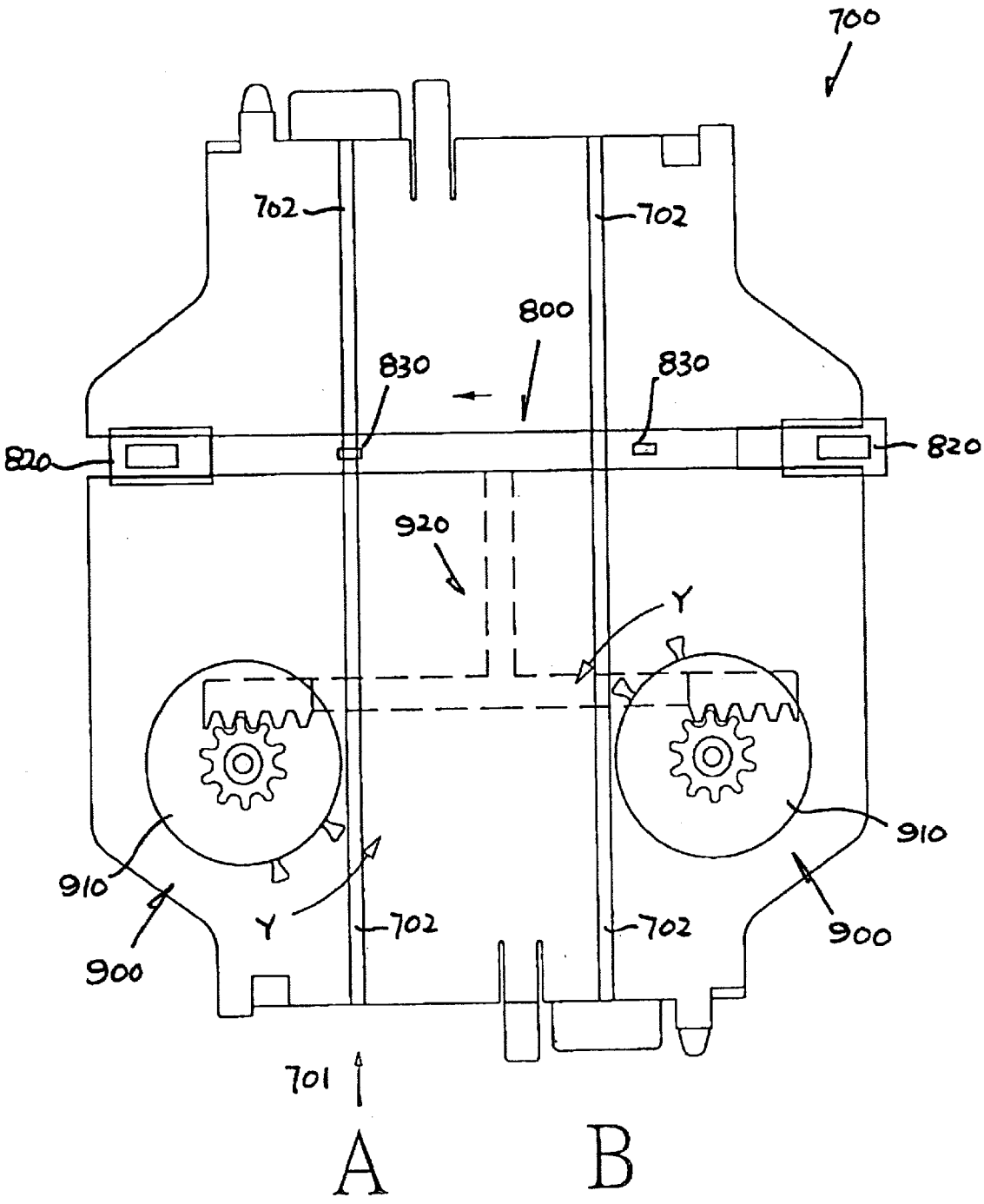
FIG. 13 is a top view corresponding to FIG. 12, showing a further subsequent operating condition of the road block and trigger mechanisms.

On the other hand, if the trailing car is running more than one lap behind the leading car such that the leading car runs past its trigger mechanism 900 again before the trailing car resets the slider 810, the slider 810 will be slid to the second next position to the right side of the central position, in which the right stop 830 is moved yet further away from the right groove 702 and the left stop 830 is moved to the right side just off the left groove 702 (FIG. 12). Although the left lane 701 is not yet blocked at this moment, it will quickly be blocked upon the trailing car subsequently running past its trigger mechanism 900 and hence returning the slider 810 one position back in the left direction or back to the last previous position (FIG. 10 previously or FIG. 13 now). This results in blocking of the trailing car and the leading car wins the game.

In essence, the road block mechanism 800 or the two stops 830 are operable to hinder the movement of the toy cars in the extreme case, i.e., by stopping their movement.

The invention has been given by way of example only, and various modifications of and/or alterations to the described embodiments may be made by persons skilled in the art without departing from the scope of the invention as specified in the appended claims.

What is claimed is:

1. A track section for a toy racing car track system including a closed loop of track sections, the track section comprising:

a body providing two lanes for respective electric toy cars to race with each other, each lane including a groove for guiding movement of a respective toy car having a bottom guide pin received in the groove, and a pair of conductive rails on opposite sides of the groove for supplying electrical power to the respective toy car, a hindering device located in each lane, each hindering device comprising a pivotable ramp and a spring resiliently biasing the ramp to incline at a an acute angle from the body relative to the respective lane, and a trigger mechanism located in each lane and including a movable component mechanically associated with the hindering device of the opposite lane, for movement by the respective toy car for triggering the hindering device of the opposite lane, thereby increasing traveling distance of the toy car traveling in the opposite lane, the movable component extends into the groove of the respective lane for movement by the bottom guide pin of the respective car for triggering the hindering device of the opposite lane, the pivotal ramp of the movable member of each hindering device is releasably retained relative to the body by the movable component of the trigger mechanism of the opposite lane, and each trigger mechanism includes a rotatable spoke-wheel having a plurality of spokes individually extendable into the groove of the respective lane for rotation of the spoke-wheel by the bottom guide pin of the respective toy car, said spoke-wheel including at least one cam for, upon sufficient rotation of the rotatable spoke-wheel for-the cam to engage the respective movable component, moving the respective movable component, thereby releasing the ramp of the opposite lane.

2. The track section as claimed in claim 1, wherein the movable member of each trigger mechanism is resiliently biased by the spring so that the ramp can be manually pressed toward and retained in the respective lane.

3. The track section as claimed in claim 1, wherein, in every position of each spoke-wheel, at least one spoke of each spoke-wheel is accessible outside of the body for manual adjustment of angular position of the spoke-wheel.

4. The track section as claimed in claim 1, wherein each spoke-wheel includes fewer of the cams than of the spokes of the respective spoke-wheel, so that the spoke-wheel does not release the ramp of the opposite lane every time the respective toy car moves the respective spoke-wheel.

5. The track section as claimed in claim 1, wherein each spoke-wheel includes a spring-loaded member and a ratchet-wheel engageable with the spring-loaded member and restricting the spoke-wheel to turn only in one direction, in steps.

6. The track section as claimed in claim 1, wherein the movable component of each trigger mechanism comprises a pivotable lever.

7. A toy car racing track system including the track section as claimed in claim 1.

* * * * *